United States Patent [19]

Gruber

[11] 3,987,387

[45] Oct. 19, 1976

[54] TRANSFORMER HAVING AN INSULATING BODY FOR A WINDING

[76] Inventor: Bruno Gruber, 2, Michl-Ehbauer-Ring, Puchheim-Bahnhof, Germany

[22] Filed: Dec. 30, 1975

[21] Appl. No.: 645,426

[30] Foreign Application Priority Data

Jan. 2, 1975 Germany ..... 2500034

[52] U.S. Cl. ..... 336/67; 336/90; 336/198

[51] Int. Cl.[2] ..... H01F 27/04; H01F 27/30

[58] Field of Search ..... 336/65, 67, 90, 98, 336/196, 198

[56] References Cited

UNITED STATES PATENTS 1,778,253 10/1930 Fischer ..... 336/198 X

FOREIGN PATENTS OR APPLICATIONS 1,137,131 9/1962 Germany ..... 336/198

*Primary Examiner*—Thomas J. Kozma
*Attorney, Agent, or Firm*—Brumbaugh, Graves, Donohue & Raymond

[57] ABSTRACT

The specification describes a transformer comprising two windings coupled by a magnetic circuit inductively with each other and a high voltage insulating body insulating the windings from each other. The insulating body has two blind holes spaced apart and ending in it, a third blind hole connecting their inner ends and running perpendicularly to them, a recess running at a distance from the third blind hole and connecting the first two blind holes, and a through hole running substantially perpendicularly to the blind holes and which passes through the zone delimited by the blind holes and the recess at a distance from the blind holes and the recess. The one winding surrounds the zone mentioned and the magnetic circuit runs through the through hole.

10 Claims, 9 Drawing Figures

Fig.1
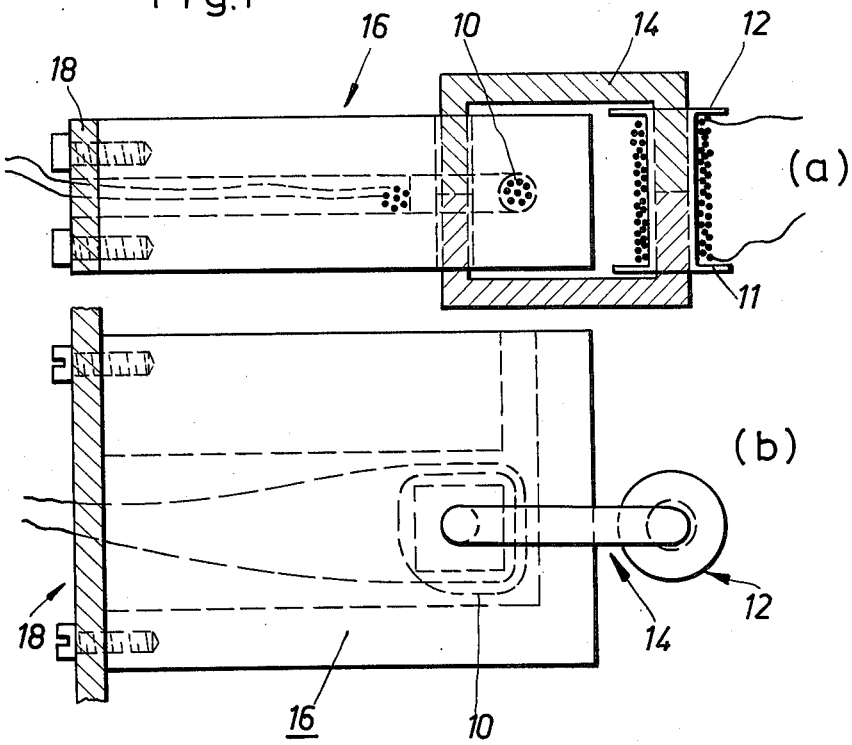
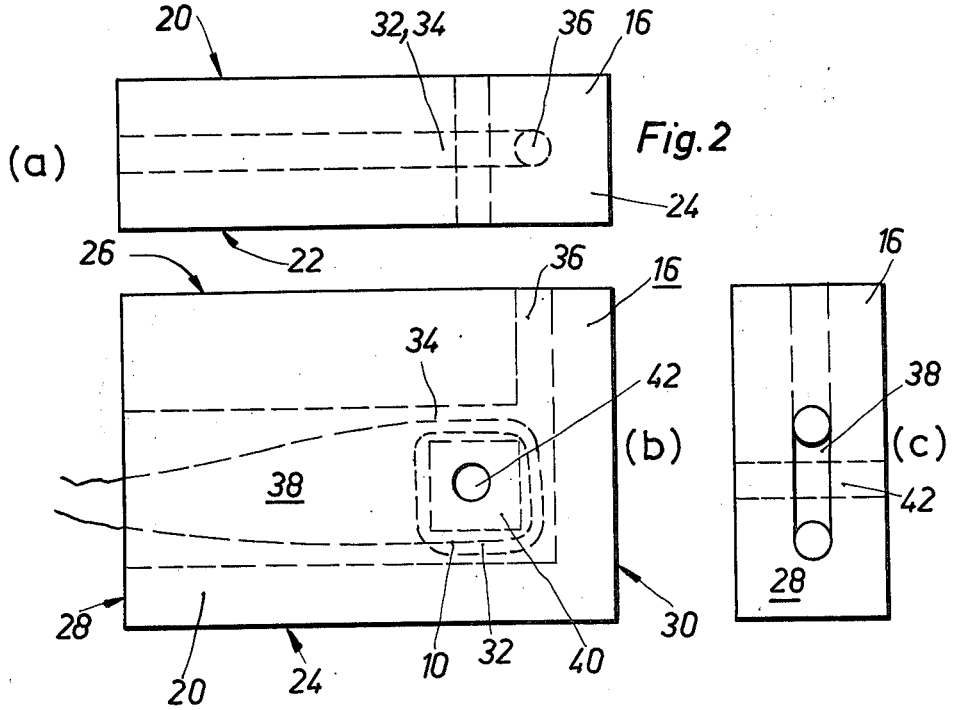
Fig.2

Fig.3
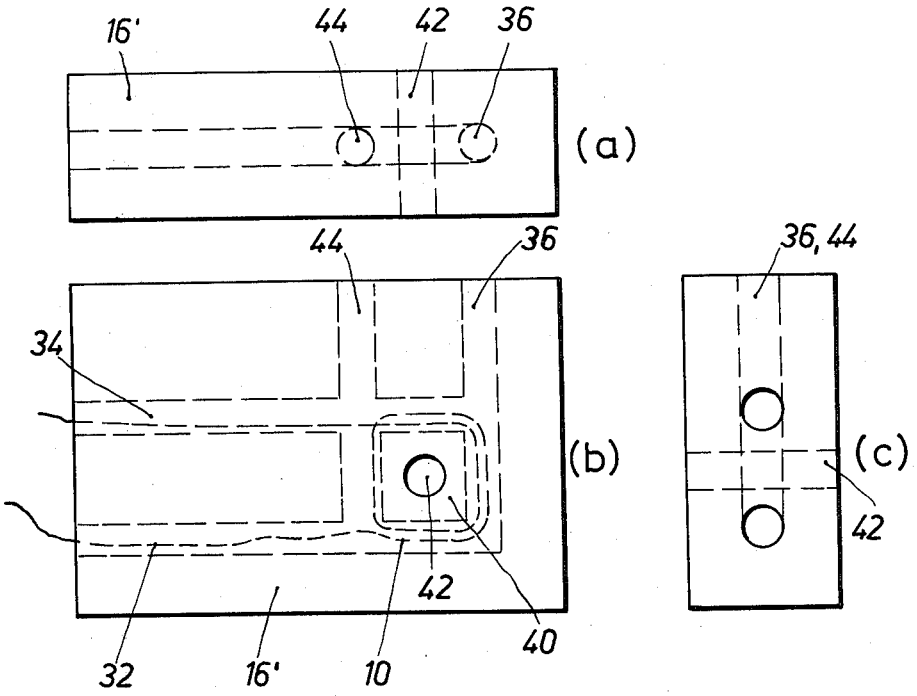
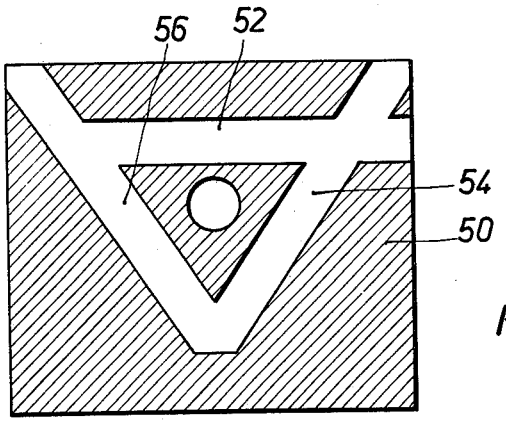
Fig. 4

TRANSFORMER HAVING AN INSULATING BODY FOR A WINDING

BACKGROUND OF INVENTION

1. Field to Which Invention Relates

The present invention relates to a transformer with two windings coupled inductively with each other and a high voltage insulating body insulating the windings from each other.

2. The Prior Art

In the prior art transformers are used for transmitting electrical energy or signals over high potential differences. Transformers for this purpose generally comprise two inductively coupled windings, which have the largest possible distance between them and are sufficiently electrically insulated from each other.

In order to afford the necessary electrical insulation the transformer can be operated under oil or as an alternative or additional feature it can be potted with an insulating potting composition. The use of oil for insulation is to say the least inconvenient while potted transformers are expensive and time-consuming to produce. They cannot be repaired and aging of the potting composition may cause deteriation of the transformers. Both in the case of oil and also of potting composition as for example a casting resin, great care must be taken to see that no air inclusions occur, which cause a substantial impairment in the voltage resistance.

SUMMARY OF INVENTION

One aim of the present invention is that of providing a transformer for high potential differences, which is characterized by a very high insulating strength and is both cheap in production and very reliable in operation and furthermore can be easily repaired if required.

Since the insulating body of the present transformer consists of a piece of insulating material which is produced independently of the transformer itself and can be tested separately, the danger of insulation faults due to air inclusions and the like can practically not occur. Production can be carried out by simple drilling and possibly milling without any special skill having to be imployed in this respect in order to achieve the desired resistance to high voltage. Expensive casting molds are not required. The transformer can be fitted if desired, for example for purposes of repair, disassembled. For a given potential difference smaller transformer cores can be used, or with a given core it is possible to achieve a substantially higher breakdown voltage.

LIST OF SEVERAL VIEWS OF DRAWINGS

In what follows embodiments of the invention will be described in detail with reference to the drawing.

FIGS. 1*a* and *b* show a side view in the plan view of a transformer in accordance with a first embodiment of the invention.

FIGS. 2*a*, *b* and *c* show views of an insulating body of a transformer in accordance with FIG. 1 from three different sides.

FIGS. 3*a*, *b* and *c* show views corresponding to FIG. 2 of another embodiment of an insulating body for a transformer in accordance with the invention.

FIG. 4 shows a sectional view of the insulating body of a transformer in accordance with a third embodiment of the invention.

DESCRIPTION OF PREFERRED EMBODIMENTS

The transformer represented in FIG. 1 as an embodiment of the invention comprises a primary 10 and a secondary 12 arranged on a winding body 11 and they are inductively coupled with each other by a magnetic core 14. For providing electrical insulation between the primary and secondary use is made of an insulating body 16, which is screwed on a metallic rail 18 and serves both for electrical insulation and also for mechanical holding of the transformer.

The insulating body consists of an insulating material as for example a polymeric plastic such as acrylic resin.

As can be seen most clearly in FIG. 2 the insulating body 16 has the form of parallelpiped with two parallel principal surfaces 20 and 22, two long narrow sides 24, 26 running normal to the principal surfaces 20 and 22, and two short narrow sides 28, 30 running normal to the above-mentioned surfaces and sides. From the short narrow side 28, to which the metallic rail 18 is fixed, there extend two-spaced parallel blind holes 32, 34 which are parallel to the principal surfaces 22 and 24 and to the long narrow sides 24 and 26 in the insulating body 16. These blind holes end at some distance short of the short narrow side 30. The ends of the blind holes 32 and 34 are connected together by means of a third blind hole 36, which extends from the long narrow side 26 parallel to the short narrow side 30 into the insulating body and ends short of the long narrow side 24.

The first two blind holes 32 and 34 are connected in parts, which are adjacent to their opening, that is to say to the short narrow side 28, by a milled-out recess 38, which, as is more especially shown in FIG. 2*b*, ends short of the third blind hole 36 so that a zone 40 is left which is delimited by the blind holes 32, 34, and 36 and also the recess 38 and in plan view is preferably of square shape. The center of the zone has a hole 42 passing through it, which connects the two principal surfaces 20 and 22 with each other and in the assembled transformer (see FIG. 1) has the magnetic core 14 passing through it.

The primary 10 encompasses the residual zone 40, as will be gathered from FIGS. 1*b* and 2*b*. Its connections are led out through the blind holes 32 and 34 and, respectively, the recess 38 to the short narrow side 28.

For producing the primary a suitable wire, preferably a litz wire is threaded around the residual zone 40, something which is facilitated by the third blind hole 36.

The magnetic core 14 can be a divided ferrite or cut tape core though it can also be made up of a stack of E- and I-shaped laminations.

The described embodiment of the invention can be so operated that the metal rail 18 and the primary 10 are substantial and ground potential, while the secondary 12 lies at a high voltage as for example 100 to 150 kV. Such voltage conditions occur for example in the case of Wehnelt high tension supply systems for electron microscopes and technical ray or beam producing equipment.

The insulation properties of the transformer are determined by the size of the insulating body, the material used and the position and the diameter of the holes or bores. Between the primary and the secondary and between the primary and the magnetic core there is only the insulating material of the insulating body 16. The holes of the insulating body are so arranged that no opening is directed either towards the secondary or towards the magnetic core. Since the insulating body can be made of a pre-fabricated plastics block or the like, there is no danger of air inclusions, which could impair the breakdown voltage. The insulating body does not comprise any adhesive joints, laminated insulating materials or the like between the primary and the secondary.

FIG. 3 shows an insulating body 16' which has been somewhat modified to depart from the construction of FIG. 2. It only differs from the insulating body 16 in regard to the fact that in place of the recess 38 which extends as far as the short narrow side 28 and is produced by milling, a fourth blind hole 44 is provided, which runs parallel to the third blind hole 36 and is spaced preferably by a distance from it, which is equal to a distance between the blind holes 32 and 34. Therefore in this case as well a zone 40 which is square in plan is formed, which is encompassed by the primary 10 and has the hole 42 for the magnetic core passing through it.

The transformers described can be operated in air or also if desired under oil. In the case of the additional use of oil as an insulating material in contrast to prior art oil-immersed transformers, there are practically no problems arising because of air inclusions and the transformer can therefore readily be filled with oil after assembly at the side of use.

The use of insulating plastics such as acrylic resins, polystyrene, polytetrafluoroethylene and the like for the insulating body 16 and 16' respectively leads to the advantage of cheap manufacture. For advanced requirements, as for example operation at higher temperatures, it is however also possible to use other materials as for example ceramic materials. Furthermore, ceramic insulating bodies can be produced cheaply, since the molds are simple and no close tolerances generally have to be observed.

In special applications, as for example with transformers for higher frequencies, it is possible to use a rod-shaped magnetic core, for example of ferrite, or the magnetic core can be completely dispensed with. In such cases the winding 12 (which is then preferably constructed in a disk-like manner) can be arranged coaxially to the primary 10 on the one face of the two principal faces 20 and 22. The winding 12 can also be split so that at the two principal faces 20 and 22 one winding half of the two winding halves connected in series is arranged.

It is also possible to arrange two insulating bodies of the type represented in FIG. 2 or FIG. 3 with threaded through windings alongside each other so that they make contact with the principal surfaces and the windings are arranged coaxially corresponding to the winding 10. The holes 32 and 34 and also 36 of the two insulating bodies in this arrangement are preferably directed in opposite directions. In both cases the windings can be coupled with each other by a rod-shaped ferrite core for example. If desired, the core can be dropped completely and in this case the hole 42 is not necessary either.

In the case of the embodiment in accordance with FIG. 4 the insulating body 50 represented in section has three holes 52, 54, 56, which can all be blind holes and can intersect in the manner represented in pairs so that an annular three-cornered space in the body is formed, in which as with the case of the embodiments previously described one wire can be threaded in order to form a winding. In other respects the transformer can be constructed as has already been described above.

I claim:

1. A transformer comprising two windings coupled by a magnetic circuit inductively with each other and a high voltage insulating body insulating the windings from each other, characterized in that the insulating body has two blind holes spaced apart and ending in it, a third blind hole connecting their inner ends and running perpendicularly to them, a recess running at a distance from the third blind hole and connecting the first two blind holes, and a through hole running substantially perpendicularly to the blind holes and which passes through the zone delimited by the blind holes and the recess, at a distance from the blind holes and the recess; in that the one winding surrounds the zone mentioned and in that the magnetic circuit runs through the through hole.

2. A transformer in accordance with claim 1, characterized in that the recess connects the first two blind holes from the surface of the insulating body as far as the zone mentioned.

3. A transformer in accordance with claim 1, characterized in that the recess consists of a fourth hole, which runs at a distance from the third blind hole.

4. A transformer in accordance with claim 3, characterized in that the third and the fourth blind holes run parallel to each other.

5. A transformer in accordance with claim 1, characterized in that the first and the second blind holes run parallel to each other.

6. A transformer in accordance with claim 1, characterized in that the insulating body has the form of an elongated parallelpiped with two rectangular principal surfaces and two short and two long narrow sides, in that the first blind holes open at one of the two short small sides; in that the third blind hole opens in a part, adjacent to the other narrow side, of the one long narrow side and in that the through hole runs from the one principal surface to the other one.

7. A transformer in accordance with claim 6, characterized in that the insulating body is provided with a holding means at the first-mentioned narrow side.

8. A transformer in accordance with claim 1, characterized in that the magnetic circuit comprises a magnetic core which extends through said through hole, and in that the second winding is arranged on this core.

9. A transformer comprising a solid body made of electrically insulating material, the body having at least first, second, and third holes extending into the body and forming intersections to form, within the body, a space encompassing a portion of the body; a first winding position within the space and surrounding the portion of the body, and a second winding positioned outside the holes and magnetically coupled with the first winding.

10. A transformer in accordance with claim 9, in which at least one of the holes is a blind hole.

* * * * *